United States Patent [19]

Diamond

[11] 4,171,757

[45] Oct. 23, 1979

[54] PRESSURIZED BARRIER PACK

[76] Inventor: George B. Diamond, Anthony and Woodglen Rds., R.D., Glen Gardner, N.J. 08826

[21] Appl. No.: 877,979

[22] Filed: Feb. 15, 1978

Related U.S. Application Data

[63] Continuation of Ser. No. 693,768, Jun. 8, 1976, abandoned.

[51] Int. Cl.[2] ..... B67D 1/04

[52] U.S. Cl. ..... 222/389; 222/402.22

[58] Field of Search ..... 222/389, 402.22, 394, 222/402.1, 402.21, 327, 387

[56] References Cited

U.S. PATENT DOCUMENTS

| | | | |
|---|---|---|---|
| 2,953,284 | 9/1960 | Prussin et al. | 222/394 UX |
| 3,216,463 | 11/1965 | Kibbel, Jr. et al. | 222/389 X |
| 3,255,936 | 6/1966 | Healy et al. | 222/389 |
| 3,581,941 | 6/1971 | Bruce et al. | 222/402.22 X |

*Primary Examiner*—Stanley H. Tollberg

*Attorney, Agent, or Firm*—Ostrolenk, Faber, Gerb & Soffen

[57] ABSTRACT

The invention provides a low pressure package or packaging system for dispensing a product of high viscosity, namely, 10,000 cps. or above at a pressure of only about 6–40 lbs. per sq. in. gauge (psig). The low pressure reduces the safety hazard to practically zero, reduces the cost of the container very substantially and minimizes the use of metals, plastics and other scarce materials. The container is preferably provided with a barrier in the form of a piston, bag, disc or the like, to separate the product from the propellant.

By reason of the low pressure, the wall of the container can be relatively thin, of the order of 0.005 inch or less in the case of aluminum in 2-inch diameter containers. The necessary thickness of materials other than aluminum (such as steel, plastic, paper board or laminates of metal, plastic and paper) will depend on their relative strengths. The use of such thin-walled containers lowers the cost of the package and at the same time renders the wall so flexible and pliable that the wall conforms to the piston or disc barrier which helps to prevent by-pass or escape of propellant gas and also allows the pressure inside to smooth out any dents occurring during transportation. The conformation of the wall to the barrier also permits almost complete expulsion of the product.

The valve is provided with a sealing disc or head secured to a tiltable stem. The sealing disc is of considerably larger diameter than those of prior valves, and maybe three or four or more times the internal diameter of the stem. The disc hinges on a small portion of its perimeter to provide a passageway for the product extending throughout 360°.

28 Claims, 6 Drawing Figures

FIG. 1
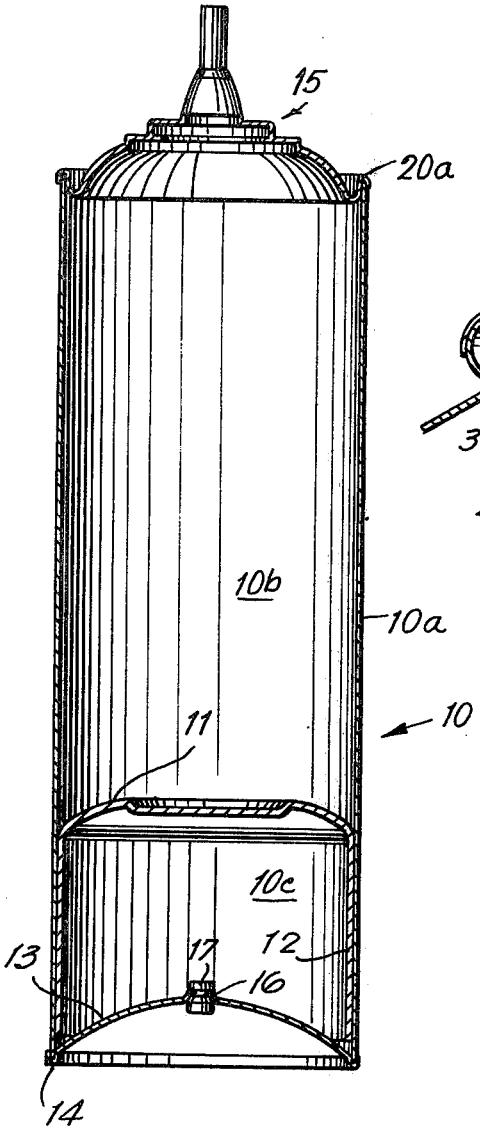
FIG. 2
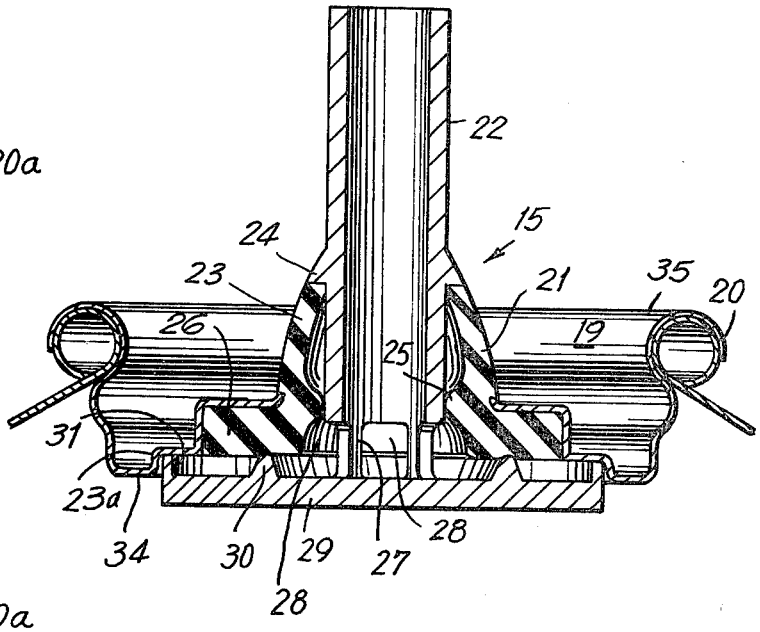
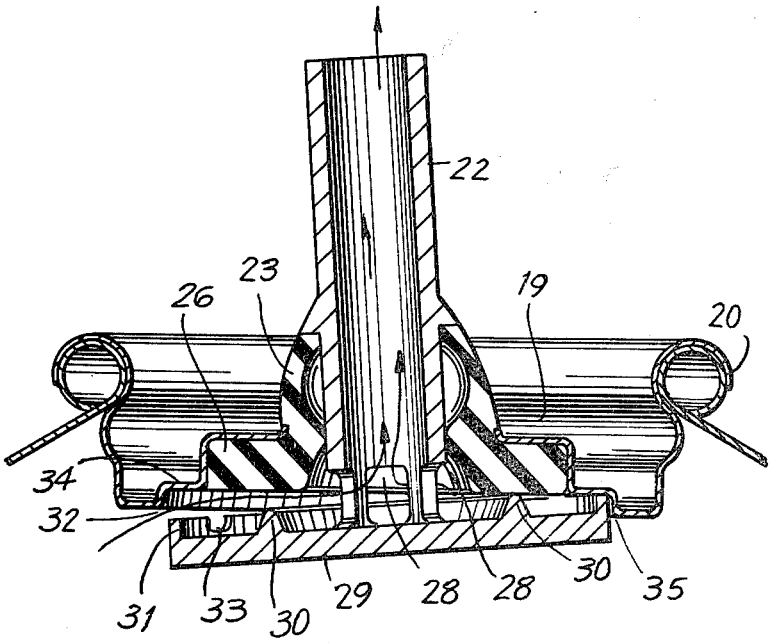
FIG. 3

PRESSURIZED BARRIER PACK

This is a continuation of application Ser. No. 693,768, filed June 8, 1976, now abandoned.

BACKGROUND OF THE INVENTION

In order to understand the invention, it is necessary first to consider the Regulations of the Department of Transportation as given in Tariff No. 30, entitled "Hazardous Materials Regulations of the Department of Transportation", including "Specifications for Shipping Containers".

The above regulation in Section 173.306 recognizes two types of pressure systems for metal containers.

1. For compressed gases, the container must withstand pressures of three times the pressure at 70° F.
2. For liquefied gases, the container must withstand one and one-half times the equilibrium pressure at 130° F.

In determining the pressure requirements for barrier containers, account must be taken of the fact that the initial volume in the container not filled with product is about one-third of the total volume, so that if compressed gas is used, the initial pressure is three times the final(minimum) pressure. For example, if for a given product, a minimum pressure of 33 psig is needed (and this is also, of course, the final pressure), an initial pressure of 99 psig is required and the container must withstand a pressure of three times 99 or 297 psig. Heretofore, inert gas propellants, when used, were of this magnitude, i.e., 90–100 psig.

When a liquefied propellant is used in order to maintain 33 psig at 70° F., it will have a pressure of ca. 100 psig at 130° F., and the container will have to withstand a bursting pressure of ca. 150 psig. To maintain an average of 66 psig at 70°, a bursting strength of 250 psig will be needed.

Valved pressurized containers have for the most part been designed for the discharge of atomized sprays of low viscosity fluids or for the discharge of foaming low viscosity fluids. In either case, the use of initial pressures at 70° F. of ca. 35 psig for liquefied gases (volatile liquids) or 100 psig for compressed gases was necessary, in order to obtain atomization or foaming. (The use of lower pressure liquefied gases in glass containers for the atomization of perfumes and the like required the use of high-priced propellants and valves.)

When the use of barrier pressure dispensers for viscous fluids started some twenty years ago and up to the present time, the only available valves and containers were the small orifice valves and high pressure containers and these have been and are still in use today. The use of these containers made it necessary to warn the consumer against leaving the containers exposed to sunlight and against throwing them into incinerators or open fires because of the danger of explosion. The prior containers, therefore, had to be made of rigid heavy gauge metal which increased their cost of production and transportation, and also made it difficult to eliminate denting and the by-pass or escape of the propellant.

BRIEF SUMMARY OF THE INVENTION

The present invention relates to the manufacture of valved containers for dispensing viscous products at an initial or charging pressure of only 6 to 40 psig, depending generally on the degree of viscosity of the product.

The invention is concerned particularly with products having a minimum viscosity of 10,000 cps. but whose viscosity may be as high as 500,000 cps., or more; and provides articles of manufacture in the form of valved pressurized containers of low pressure and hence of practically complete safety, and preferably pressurized containers wherein the product is separated from the propellant by disc, piston or collapsible bag.

A novel form of discharge valve is employed which affords such a large cross-sectioned flow area that a satisfactory rate of flow through the valve is attained despite the low propellant pressure. By reason of the reduced pressure, the wall of the container, when of metal, can be greatly reduced in thickness as compared to pressurized containers charged at 100 psig or higher, so that in addition to the lower cost of the reduced pressure, still further economy results from the use of smaller weights of metal, while at the same time wastage of metal is reduced. Similar economies are effected in the case of container walls made of plastic, laminates, and other materials including paper having surfaces impervious to liquids and gases.

According to the invention, products of high viscosity of, say 10,000 cps and above, are packaged in a container at initial compressed gas pressures of ca. 6–40 psig at 70° F. or initial liquefied gas pressures of ca. 6–24 psig at 70° F.

The 6 psig compressed gas requires a bursting strength of three times or 18 psig, and the 6 lb. liquefied gas requires a bursting strength of one and one-half times the pressure at 130° or 60 psig. The 40 psig compressed gas requires a bursting strength of 120 psig, and the 24 psig liquefied gas also requires a bursting strength of 120 psig. Containers of the present invention accordingly do not need to have a bursting strength higher than 120 psig.

Since a compressed gas at an initial pressure of 40 psig gives a final pressure of ca. 13 psig, the use of liquefied gas at 13 psig would give the same final flow characteristics. The bursting pressure required for 13 psig liquefied gas is 75 psig, but if the liquefied gas is used in a novel way, described below, the bursting pressure required can be reduced even further.

According to a further feature of the invention, the quantity and type of liquefied gas to be used are calculated and determined, so that it is completely evaporated before the 130° F. temperature is reached, whereupon it then acts as compressed gas, giving a lower pressure at 130°, and above, than would otherwise be reached (i.e., with a continuing supply of liquid propellant), and therefore allowing even thinner walls for the package and even greater safety.

By way of example, and in accordance with the invention, there is employed, for a 6 fluid oz. container, a quantity of a volatile liquid fluorocarbon propellant, such as "Freon", less than 4 g. within the skirted piston, described hereinafter, and having a volume of about 2 oz., in contrast to the 7 to 10 g. employed in current practice, for the 6 oz. can, the amounts varying somewhat, depending on the specific fluorocarbon. Similar reductions in the amount of a volatile liquid hydrocarbon or other liquid propellant can be made in accordance with the present invention for the purpose stated.

The limited quantity of volatile liquid propellant can be mixed with air, nitrogen or carbondioxide, which on becoming mixed with the maximum amount of vapor originating in the liquid propellant, will yield a mixture of gas and vapor having only the incremental increase in pressure per degree of increase in temperature, according to the gas laws. Hence, when temperature rises, the liquid propellant is completely evaporated at a pressure which is considerably below the legal limitations on pressures.

Also, according to the invention, valves of increased flow-through cross-section are used, while the container is made of much thinner metal than heretofore, similar to the containers for beverages, or a combination of metal foil and cardboard, or of plastic or laminates of cardboard and plastic film can be used, so that the cost of a valved container of 6–8 oz. capacity is in the neighborhood of 10–12 cents in contrast to the cost of 17–21 cents for the present-day valve container. In fact, a 16 oz. valved container would cost only about 13 cents, as compared to about 25 cents for a present-day valve container of equal volume, if such were available, which it is not, owing to the prohibitive cost. Since the retail cost to the consumer is from 3 to 5 times the manufacturing cost, savings to the consumer of from 20 cents to 35 cents per package are feasible.

If the cost of discarding dented containers and malfunctioning containers is also included, an even greater saving is possible since the invention also minimizes malfunction and denting.

In contrast to prior pressurized containers, with or without barrier, the above invention accordingly presents the following 1. Economic advantages - lower cost.
2. Safety advantages - lower pressure.
3. Ecological advantages, i.e., less material is used per container, and the use of metals and plastics is conserved.
4. Denting problem is solved.

DESCRIPTION OF THE FIGURES OF THE DRAWING

In the accompanying drawing:

FIG. 1 is a central section, partly in elevation, of a low pressure barrier container constructed in accordance with the invention.

FIG. 2 is an enlarged view, in central longitudinal section, of the tilt discharge valve in the closed condition.

FIG. 3 shows the valve of FIG. 2 in the open condition.

DESCRIPTION OF PREFERRED FORM OF THE INVENTION

Figure 4:
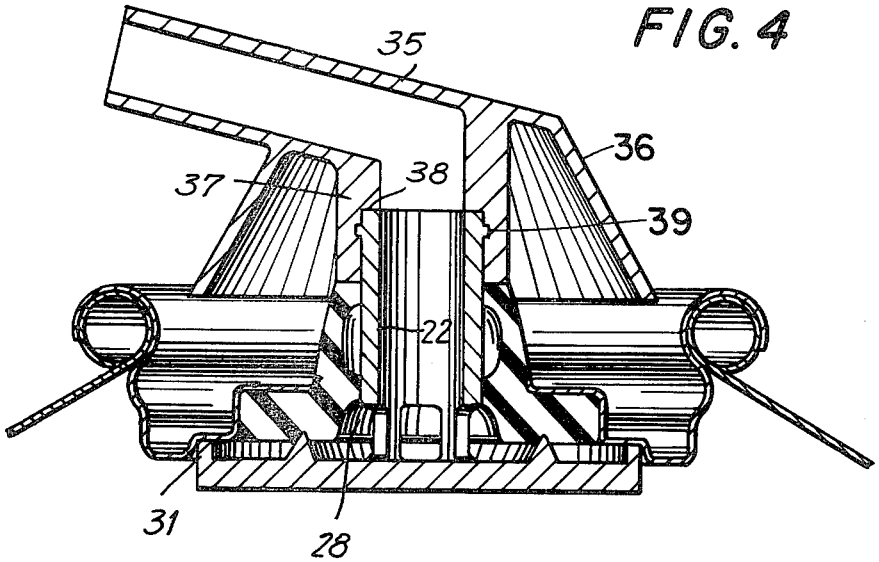
FIG. 4 is a central section through a modified form of valve.

Referring to FIG. 1, the container is indicated at 10 and is provided with a cylindrical wall **10*a*. It houses a barrier in the form of a piston 11 having a depending skirt 12. The bottom 13 of the container is sealed to the body or wall of the container by double seaming, as indicated at 14**.

The product space **10*b* of the container is filled with the product through the open cylinder at the top thereof and prior to the installation of the valve 15. After the valve structure has been sealed to the top of the container (the valve being in the closed condition), the space 10*c* below the piston 11 and within the skirt 12 is charged with a quantity of propellant at a pressure of 6 to 40 psig through a port 16 which is thereafter closed by a plug 17** of rubber or the like.

In accordance with the invention, and by virtue of the reduced internal pressure, the cylinder or shell of the container, and also the bottom wall thereof, are made considerably thinner, and thus of lower weight, than such parts have heretofore been made for pressurized containers, whether of metal, plastic, paperboard or the like. Thus the cylindrical body 10 may be made of aluminum, as in beer and soft-drink cans, with a wall thickness of approximately 0.005 inch, in contrast to the approximately 0.015 inch thickness of a standard aerosol can.

The tubular body 10 of the container can also be formed of extruded thermoplastic material with a wall thickness of 0.015 inch to 0.030 inch, or it may be made of cardboard with a facing of plastic or metal foil, or having a resin-treated surface impervious to gases and liquids.

There may be provided sufficient clearance between the skirt 12 and the interior surface of the container **10*a* to allow some of the product to enter the clearance space and form a seal between the propellant which is contained in the space 10*c* and the product occupying the space 10*b*** above the piston.

With the container filled at reduced pressure as above described, there is employed a discharge valve capable of delivering the product at an acceptable rate both at the original pressure and even as the pressure falls on successive discharges.

Satisfactory valves for the use in combination with the above-described containers and having he necessary high flow-through capacity within the limited confines of the valve cup, or equivalent structure, are illustrated by way of example in FIGS. 2 to 5.

Figure 6:
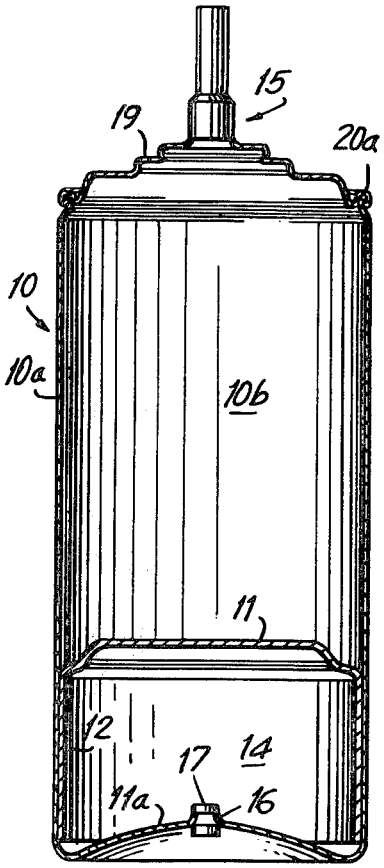
FIG. 6 is a view similar to FIG. 1 of a modified container constructed with an integral bottom.

The valve body includes a metallic, preferably aluminum, frame or cup 19 which can be crimped to the top edge of the body **10*a*, as indicated at 20, or double-seamed to the top edge of the cylinder, as shown at 20*a* in FIG. 6**.

Referring particularly to FIG. 2, the valve includes the body of resilient rubber 21, or the like, which is sealed to the stem 22 through which the product is discharged on opening of the valve. The body 21 includes a bowed portion 23 of annular cross-section whose upper edge abuts against the shoulder 24 formed on the stem 22, thereby providing a seal at such region, and also a point of compression when the stem is tilted. The portion 23 of the valve body is arched downwardly and is then turned inwardly, as shown at 25, to form a further seal with the bottom portion of the stem 22. The body 21 has an extension in the horizontal direction to form an annular seat 26 whose function will be described hereinafter.

The bottom of the valve stem 22 is in the form of spaced posts 27 providing passageways or ports 28 therebetween which lead into the interior of the valve stem. The bottom ends of these posts are rigidly secured to a circular valve disc 29. The disc is provided with an annular sealing rib or ring 30 which normally penetrates into the seat 26 to provide a seal between the interior **10*b* of the container and the interior of the stem 22. The sealing ring 30 is located between the center of the valve head and its periphery. The raised edge 31 is provided with a number of notches 33 to facilitate flow of product above the ring 30 when the valve is opened, the edge 31** then functioning principally as the fulcrum and as a spacer.

It will be evident from FIG. 3 that upon tilting of the stem 22 in any direction, the disc 29 will fulcrum about its perimeter and particularly at the raised edge 31 at a considerable distance from the longitudinal axis of the stem, so that (as is shown at 32 in FIG. 3), a large opening is made available for the discharge of the product from the interior 10*b* and into the stem 22.

Upon the tilting of the stem 22, the porton of the body 23 of the valve located in the direction of tilt is compressed, so that upon release of the stem, the latter is returned to its normal vertical position. When this occurs, the valve head 29 is returned into its closed condition in which the sealing ridge 30 is pressed into the seat 26. In the open condition of valve head 29, the product flows into the passageway 32 through which it bypasses the seal 30, where part of such seal remains in engagement with the seat.

It will be evident that when the tem 22 is tiltd, its bottom end posts 27 tilt the valve 29 downwardly, so that the product is able to pass between the raised edge 31 and the bend 34 in the valve cup. The resilience of the vertical portion 23 of the valve body enables the valve had to return to the closed, sealing position when the stem is released.

The modification of FIG. 4 facilitates the side discharge of the product. In this embodiment, the valve stem fits at its upper end into a sleeve 37 forming part of a laterally directed nozzle 35 which is provided with a downwardly extending hood 36 serving to shield the valve. The sleeve 37 presents a shoulder 38 against which stem 22 abuts, an annular groove being provided in the portion 37 for receiving an o-ring 39 of rubber or the like, to seal the valve stem at such point. In other respects, parts corresponding to the valve parts shown in FIGS. 2 and 3 are similarly numbered, and function in the same way.

It will be noted that, as in FIGS. 2 and 3, the raised edge 31 of the disc abuts against a downwardly extending portion of the valve cup to prevent side movement of the valve head upon tilting of the stem.

As is shown in FIG. 4, by reason of the fact that the hinge of the disc 29 is disposed at a rather large distance from the central axis of the valve stem, a small degree of tilt of the stem results in quite a large opening of the valve about its raised edge, thereby affording the valve a large flow capacity.

Figure 5:
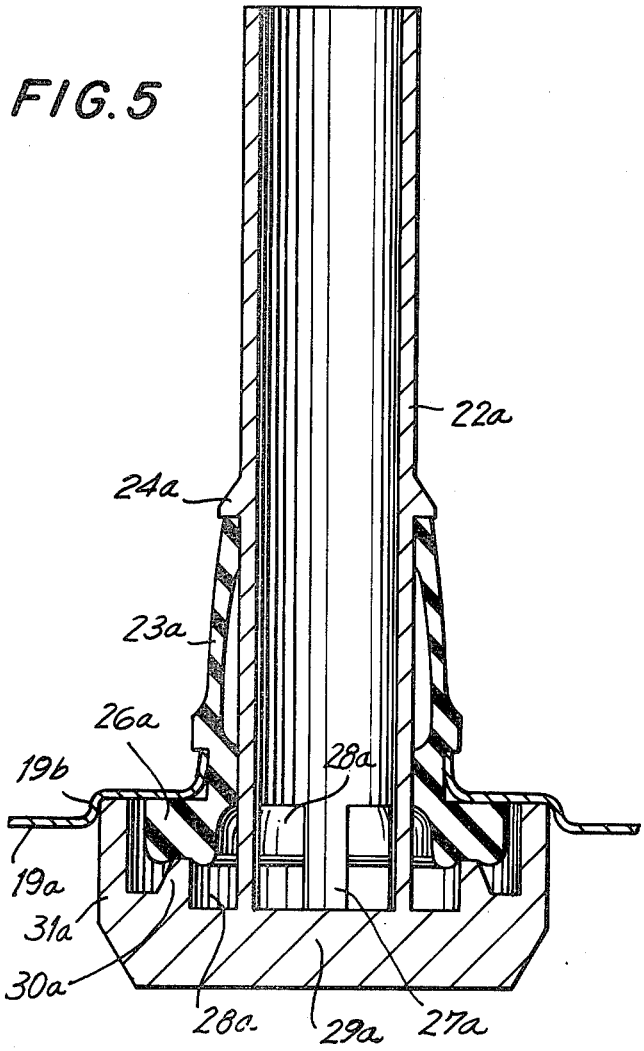
FIG. 5 is a central section through a further modification.

An even larger path for the product is provided for a given angle of tilt in the modification of FIG. 5, wherein the fulcruming ring on the periphery of the valve head extends considerably above the bottom surface of the seat, and in the tilting action of the head engages a portion of the valve cup beyond the periphery of the valve seat, thereby increasing the radii of tilt both of the sealing ring and of the fulcruming ring.

As shown in FIG. 5, the parts corresponding to those shown in FIGS. 2, 3 and 4 are indicated by the same numerals but with the letter "a" attached.

The principal differences over the structures of FIGS. 2, 3, and 4 reside in the greater height of the fulcruming ring 31*a* than the sealing ring 30*a*, the top of the ring 31*a* being also considerably higher than the bottom surface of the valve seat 26*a*, and in the greater radius of tilt of the valve head.

As in the other figures, the sealing ring 30*a* spaces the top surface of the valve head 29*a* from the bottom surface of the valve seat 26*a*, which allows the ports 28*a* to extend for a considerable distance below the bottom of the valve seat.

The fulcrum ring 31*a* extends to a shoulder 19*b* of the valve cup, it being immaterial whether the ring exercises a sealing function against the valve cup or not. However, the shoulder 19*b* serves to center the valve head and prevents lateral displacement thereof on tilting of the valve stem 22*a*.

Upon tilting of the stem 22*a* in any direction, the ring 31*a* will fulcrum against the shoulder 19*b* and will effect a relatively large opening movement in the region of the diagonally opposite point of the ring 31*a* from its fulcrum by reason of the larger diameter of the valve head than its seat and the location of the fulcrum above the seat; so much so, that all of the sealing ring 30*a* is quickly separated from the valve seat on tilting of the stem 22*a*, and the product has access to all the ports 28*a* throughout the full 360°, with resultant low resistance to flow through the valve.

As in the other embodiments, the spacing of the top surface of the valve head from the bottom surface of the valve seat enables larger ports 28*a* to be easily provided at the bottom of the stem, i.e., they can be of increased height and hence afford increased flow cross-sectional area.

FIG. 6 shows a pressurized container in which the bottom wall is not in the form of a separate member, crimped or double-seamed to the bottom edge of the container sidewall or shell, but is constructed in the manner of a beer can in which the bottom is integral with the side wall of the container. However, the bottom 11*a* is provided with a charging port 16 as in FIG. 1, for charging the propellant under pressure, after which the port is sealed with the usual plug 17.

The valves above described have a much greater rate of discharge of viscous materials of 10,000 cps and above at the reduced pressures than the known Clayton valve operating with a container charged at the same reduced pressure with the same materials. Thus, a Clayton valve employed with a pressurized container partly filled with a cheese preparation having a viscosity of about 300,000 cps, the valve having 3 openings at the bottom of the stem, each of about 0.09 inch in diameter delivered at 20 psig, a flow rate of only 0.2 g. per second, which is not acceptable for cheese.

The valves described herein and likewise provided with 3 ports at the same location in the vertical stem as in the Clayton valve, yielded a flow rate for the same cheese preparation of 0.8 g. per second at 20 psig, which is an acceptable rate.

The considerably lower cost of pressurized valved packages of the invention has been stated hereinabove.

Specifically, in the case of tooth paste tubes, which at present are non-pressure packages, the largest practical size is 8 oz. and costs 10–11 cents (for the collapsible tube). In the quantities used by tooth paste manufactures, my improved pressure pack can be sold at about the same price. Larger economy size tooth paste tubes are not marketed because they are too combersome to handle. A low pressure barrier pack which will hold 12 oz. of tooth paste can be more easily handled and will cost 13–14 cents, which is about 1.125 cents/oz. This means that 12 oz. of tooth paste can be sold (including paste) for substantially less per oz. than collapsible 8 oz. tubes.

Similarly, significant economics will be obtained in the pressurized packaging of other fluent materials of viscosities of 10,000 cps and above, such as cheese, spreads, greases, lubricants, hair pomades, and the like. In general, charging pressures of 10 to 15 psig will be adequate to yield satisfactory rates of discharge for the viscous materials provided that a high capacity discharge valve, such as above described, is employed.

The economic advantage of plastic containers with a 0.02 inch wall (as permitted by the present invention), as compared to the known 0.06 inch wall, is illustrated by the following:

Polyesters and acetals sell for about 80 cents/lb., and a 2 fluid oz. plastic container weight about 1 oz. for a 0.06 inch wall and 0.33 oz. for the 0.01 inch wall which is adequate in accordance with the invention, a saving of 0.67 oz. for 3.3 cents/unit.

Examples of plastics and their tensile strengths, as well as the wall thhicknesses which will insure against bursting in containers having an outside diameter of 2 inches at different pressures, are listed in the following table:

| Plastic Type | Tensile Strength psi | Wall Thickness for 2" O.D. Cans in inches: For 30 psi | For 100% Safety Factor | For 200% Safety Factor |
|---|---|---|---|---|
| Polyethylene, Polypropylene, Acrylonitrile-Butadiene-Styrene | 2,500 | .012 | .024 | .036 |
| Polyesters, Acrylics | 5,000 | .006 | .012 | .018 |
| Nylon, Polyesters, Polycarbonates, Acetals, Reinforced Plastics | 10,000 | .003 | .006 | .009 |

Wall thickness for 1" O.D. cans are half of the above and for other O.D.'s in proportion.

The table indicates minimum thickness and shows only relative strengths, and not necessarily the thicknesses that will be used practically.

There is considerable overlap of plastic strengths and the above is only a guide.

Currently available plastic barrier containers have wall thicknesses in the range of about 0.100 or more for the lower strength plastics and about 0.060 for the strongest onces. Some of the wall thicknesses in the above table are too thin for practical use, but they can be increased to within a practical range while still remaining below 0.100 inch and 0.060 inch.

The following propellants in various admixtures can be employed in my improved pressurized packages, the proportion of liquid propellants being limited in the amounts and for the reasons set forth hereinabove.

EXAMPLES OF PROPELLANTS

Pressure range 6–30 psig. Propellants and gases and mixtures of gases and propellants, but not limited to the following:

I. For the 30 psig. range:

40% propellant 12, 60% propellant 11
25% propellant 12, 75% propellant 114
20% propellant 115, 80% propellant 114
Mixtures of propellants 22 with 113 and/or 114 and/or 21 Propellant 318.

Hydrocarbon blends such as Butanes and Propanes with low pressure hydrocarbons such as Pentanes, i.e., both the normal hydrocarbons and their isomers Air, nitrogen, carbon dioxide, any other inert gas at 30 psig.

II. For the 6 psig. range:

12% propellant 12, 92% propellant 11
20% propellant 12, 80% propellant 113
90% propellant 114, 10% propellant 113
Propellant 21

Hydrocarbon blends of Pentanes with high pressure hydrocarbons such as Butanes and Propanes, i.e., both normal hydrocarbons and their isomers.

Air, nitrogen, carbon dioxide, any other inert gas at 6 psig.

For intermediate pressure range, different percentage mixtures of the above propellants will be used.

The above-named propellants and the proportions of mixtures of propellants for obtaining the specified pressures were taken from the well-known DuPont chart, from which the proportions for a 40 psig charging pressure, as well as for intermediate pressures between 6 and 40 psig. can be readily obtained.

Propellant 11 is Trichloromonofluoromethane
12 is Dichlorodifluoromethane
21 is Dichloromonofluoromethane
22 is Chlorodifluoromethane
114 is Dichlorotetrafluoromethane
318 is Octafluorocyclobutane
315 is Chloropentafluoroethane
113 is Trichlorotrifluoroethane The use of propellants other than air, nitrogen, or carbon dioxide is minimized in the described system, and where used will be used in smaller quantities.

As indicated above, the propellant can be either a gas at a charging pressure of 6 to 40 psig, or a volatile liquid at a charging pressure of 6 to 24 psig, or a mixture of a gas at the just-mentioned pressure with a liquid propellant, the liquid in any case being in the limited amount which will all be evaporated to the vapor state before the temperature reaches 130° F.

In the filling of the container, there is provided the cylindrical shell which is open at the top and has a bottom wall which is either integral with the shell or is secured thereto in gas-tight manner. The bottom wall contains a charging port while the shell is provided with the barrier, preferably in the form of a hollow piston open at its bottom and occupying about one-third of the container interior. The product is to be dispensed is then introduced through the open upper end, and the valve assembly is secured to the shell in leak-proof manner. The propellant is now charged into the piston through the port in the bottom wall, after which the port is plugged or otherwise sealed.

I claim:

1. As an article of manufacture, a self contained, sealed pressurized barrier container formed of flexible material and sealed at one end and having a discharge valve at the other end, a piston in the container and serving as a gas tight sealing barrier therein for defining two chambers, one chamber communicating with the valve and containing a product for discharge at the pressure of a propellant within the other chamber of the container, the container being of such reduced thickness and strength that it could not withstand an internal pressure in the container greater than 120 psig, the wall of the container being thick and strong enough to contain the internal pressure to 120 psig and being thin enough so that even at low internal pressure, the piston may move through the container and during such movement may somewhat deform and restore the container wall if it had been deformed before the piston had moved therethrough, the piston having such strength as to be able to conform to the wall of the container and the container wall being sufficiently deformable that the piston maintains its seal with the container wall as the piston moves through the container, the valve being constructed, on opening, to afford an effective flow-through cross-sectional area allowing a useful rate of discharge of at least 0.8g per second at the said pressure and maintaining an effective flow rate at the reduced pressures following incremental discharges from the container.

2. An article of manufacture according to claim 1, wherein the sealing ring is located between the center of the valve head and the periphery of the valve head.

3. An article of manufacture according to claim 1, wherein the wall of the container is of such reduced thickness that the internal pressure is capable of straightening out dents in the wall.

4. An article of manufacture according to claim 1, wherein the container wall is made of aluminum, and wherein the thickness of the container wall in inches is approximately equal to the product of the container diameter in inches multiplied by 0.0025.

5. An article according to claim 1, wherein the valve includes a hollow valve stem having a plurality of ports therein for receiving the discharging product on opening of the valve, a valve head secured to the bottom of the stem to be actuated on tilting of the stem, an annular valve seat through which the stem passes, and a sealing ring projecting above the top surface of the head and engaging the bottom surface of the seat to seal the stem against access by the product when the valve is closed, said sealing ring acting also to space the valve head from the valve seat in the closed condition of the valve and enabling the stem to extend below the bottom surface of the valve seat, the ports in the stem extending below the bottom of the valve seat so that all ports are accessible to the flow of product over the sealing ring on opening of the valve.

6. An article of manufacture according to claim 1, wherein the wall of the container is made of cardboard which is lined interiorly with a liquid-impervious foil.

7. An article of manufacture according to claim 1, wherein the wall of the continer is composed of plastic material.

8. An article of manufacture according to claim 1, wherein the valve includes a valve seat, a hollow stem for the discharge of the product, and a valve head secured to the stem and tiltable therewith, the valve head fulcrumming at a portion of its periphery, and the outside diameter of the valve head being approximately 3 to 5 times the internal diameter of the stem.

9. An article of manufacture according to claim 1, wherein the valve comprises a body providing an annular valve seat, a hollow valve stem passing through the valve seat and through which the product is discharged under pressure, a valve head bearing against the seat to cut off flow of product into the valve stem, the valve stem having at least one entry port and being connected to the valve head, the stem being operable to move the head away from the seat to provide a passageway for the product to the ports of the stem, and an annular sealing ring projecting above the top surface of the head and, in the closed condition of the valve, bearing against the bottom of the seat under the pressure of the product against the bottom surface of the head to effect sealing of said passageway.

10. An article of manufacture according to claim 9, wherein the valve stem is tiltable and wherein the valve head, on tilting of the stem, is tilted about a fulcrum at its periphery, to afford a wedge-shaped passageway for the product, said passageway being then at a maximum height at a point diametrically opposite the fulcrum and diminishing toward the fulcrum.

11. An article of manufacture according to claim 9, wherein the top surface of the valve head is spaced from the bottom surface of the valve seat, in the closed condition, and wherein the stem extends below the bottom surface of the seat, the entry ports extending substantially to the top surface of the head and below the level of the bottom of the seat.

12. An article of manufacture according to claim 9, wherein the valve body is shaped to provide an annular chamber extending substantially to the tops of the ports in the stem and encompassing the same, whereby upon opening of the valve, the product whose flow is controlled by the valve has access to all the ports by way of such chamber.

13. An article of manufacture according to claim 1, wherein the wall of the container is made of a material of such nature and thickness that it will not burst at an internal pressure below 120 psig.

14. An article of manufacture according to claim 9, including means for barring the valve head against lateral displacement.

15. An article of manufacture according to claim 1, wherein the container is provided with a valve cup having a downwardly extending wall, and wherein the valve is provided with a hollow discharge stem having a plurality of ports about its bottom end for the entry of the product under pressure, the valve having an annular seat and a head secured to the stem, the head being of larger diameter than the seat, and extending substantially to said valve cup wall, so that on tilting of the stem, the head fulcrums against the wall and beyond the periphery of the seat and affords a passageway for the product for a full 360° about the ports, so that the port or ports on the downstream side as well as the port or ports on the upstream side, receive the discharging product through substantially their total cross-sectional flow areas.

16. An article of manufacture according to claim 1, wherein the valve includes a valve seat, an abutment above the bottom surface of the seat and beyond the periphery of the seat, a tiltable hollow valve stem provided with entry ports for the discharge of the product, and a valve head secured to the stem and tiltable therewith, the valve head engaging the valve seat in the closed condition of the valve and being of larger diameter than the seat and having a raised peripheral edge extending above the level of the bottom of the valve seat and engaging the said abutment on opening of the valve to fulcrum thereagainst, whereupon the valve head is removed completely from engagement with the valve seat.

17. An article of manufacture according to claim 1, wherein the propellant contains a liquefied gas in such limited amount that it is all evaporated before the temperature reaches 130° F.

18. As an article of manufacture, a container body suitable for use in the manufacture of a valved, self contained, sealed, pressurized container, the container being sealed at one end and open at the other end for receiving the product to be discharged and for receiving also a control valve for manually regulating the discharge of the product, the container having a bottom wall provided with a port for receiving a propellant under pressure, the container being of such reduced thickness and strength that it cannot withstand an internal pressure greater than 120 psig, the wall of the container being made of flexible material such that dents in the wall are capable of being straightened out by the internal pressure, the body having therein a slidable barrier piston to serve as a separator between a to-be-dispensed product introduced through the open end and a propellant introduced through the port in the bottom wall; the wall of the container being thick and strong enough to contain the internal pressure to 120 psig and being thin enough so that even at low internal pressure, the piston may move through the container and during such movement may somewhat deform and restore the container wall if it had been deformed before the piston had moved therethrough, the barrier piston sealingly engages the container wall along its full height and having such strength as to conform to the wall of the container and the container wall being sufficiently deformable that the piston maintains its seal with the container wall as the piston moves through the container.

19. A container body according to claim 18, wherein the container wall is made of aluminum, and wherein the thickness of the container wall in inches is approximately equal to the product of the container diameter in inches multiplied by 0.0025.

20. An article of manufacture according to claim 18, wherein the wall of the container body is made of cardboard provided with a liquid-impervious surface interiorly thereof.

21. An article of manufacture according to claim 1, wherein the container wall is made of aluminum, and wherein the thicknss of the container wall is approximately 0.005 inch.

22. An article of manufacture according to claim 1, wherein the charging pressure is 10 to 15 psig and the valve provides a sufficiently large flow-through orifice to effect discharge of the product at the charging pressure of the propellant, and at the repeatedly reduced pressures after successive discharges.

23. An article of manufacture according to claim 1, wherein the pressure within the container is 20 psig and wherein the product is of approximately 300,000 cps viscosity, the valve being of such large flow-through capacity that upon opening of the valve, the product is discharged at the rate of about 0.8 g. per second.

24. An article of manufacture according to claim 1, wherein the container is formed of plastic material and has a wall thickness of less than 0.060 inch.

25. The method of filling self contained, sealed, pressurized containers which are to be charged with a quantity of a product to be dispensed therefrom, and with a propellant, comprising providing a container open at the top and having a bottom wall with a charging port therein, the container housing a movable container wall sealing barrier piston therein, the container being of such reduced thickness and strength that it could not withstand an internal pressure greater than 120 psig, the wall of the container being thick and strong enough to contain the internal pressure to 120 psig and being thin enough so that, evan at low internal pressure, the piston may move through the container and during such movement may somewhat deform and restore the container wall if it had been deformed before the piston and moved therethrough, charging the product through the open end into the space above the barrier piston, sealing a valve assembly to the upper edge of the container, and charging a gaseous propellant into the space below the barrier piston until a pressure of 6 to 40 psig at room temperature is reached, or a liquid propellant until a pressure of 6 to 24 psig at room temperature is reached, and then sealing the charging port.

26. The method to claim 25, wherein the propellant is one that attains a maximum pressure of only about 90 psig at 130° F.

27. A method according to claim 25, wherein the propellant includes a compressed gas charged at a pressure of about 10 to 15 psig, the volatile liquid being present in such limited proportions that it is completely evaporated below 130° F.

28. An article of manufacture according to claim 18, wherein the container wall is made of aluminum, and wherein the thickness of the container wall is approximately 0.005 inch.

* * * * *

UNITED STATES PATENT AND TRADEMARK OFFICE

CERTIFICATE OF CORRECTION

PATENT NO. : 4,171,757
DATED : October 23, 1979
INVENTOR(S) : George B. Diamond

It is certified that error appears in the above-identified patent and that said Letters Patent are hereby corrected as shown below:

Claim 2, line 1, change "1" to -- 9 -- .

Signed and Sealed this

*Ninth* Day of *December 1980*

[SEAL]

*Attest:*

SIDNEY A. DIAMOND

*Attesting Officer*

*Commissioner of Patents and Trademarks*